United States Patent [19]

Gettelfinger

[11] Patent Number: 4,611,809

[45] Date of Patent: Sep. 16, 1986

[54] GOLF PUTTING PRACTICE APPARATUS

[76] Inventor: Irvin Gettelfinger, Rte. 2, Box 133, Palmyra, Ind. 47164

[21] Appl. No.: 688,991

[22] Filed: Jan. 4, 1985

[51] Int. Cl.[4] ..... A63B 67/02

[52] U.S. Cl. ..... 273/176 H; 273/176 K; 273/178 B; 273/179 R; 273/127 C; 273/123 A

[58] Field of Search ..... 273/176 H, 176 F, 176 FA, 273/176 K, 178 R, 178 A, 178 B, 179, 180, 127 R, 127 B, 127 C, 110, 113, 115, 123, 125, 87, 87.2, 87.4; 108/4, 8

[56] References Cited

U.S. PATENT DOCUMENTS

| | | | |
|---|---|---|---|
| 402,909 | 5/1889 | Duncan | 108/8 |
| 1,319,038 | 10/1919 | Beeler | 273/125 A |
| 1,736,316 | 11/1929 | Lasting | 273/125 R |
| 2,334,540 | 11/1943 | Buffham | 273/176 H |
| 2,562,126 | 7/1951 | Rishel | 273/110 |
| 2,609,199 | 9/1952 | Koener | 273/125 A X |
| 2,944,858 | 7/1960 | Engelsted | 108/4 |
| 3,184,239 | 5/1965 | Heuser | 273/180 X |
| 3,366,388 | 1/1968 | Del Raso | 273/176 H |
| 3,488,057 | 1/1970 | Fussell, Jr. et al. | 273/179 R |
| 3,727,917 | 4/1973 | MacLean | 273/176 H |
| 3,831,949 | 8/1974 | Henning | 273/176 H |
| 4,211,417 | 7/1980 | Brown | 273/176 H |

*Primary Examiner*—Paul E. Shapiro

*Attorney, Agent, or Firm*—Jon C. Winger

[57] ABSTRACT

A golf putting practice range apparatus includes a shooting area, a putting surface and a golf ball target hole at the down-range end of the putting surface. The golfer stands on the shooting area and hits a ball over the putting surface in an attempt to sink the golf ball into the target hole. The target hole is adapted to be selectively moved to present different target locations. Further, the putting surface is adapted to provide for selectively changing its contour. The practice range also includes a ball return system which returns golf balls back to the shooting area for reuse. In one embodiment the golf ball target hole is selectively movable linearly transversely of the longitudinal axis of the putting surface. In another embodiment, the putting surface includes a plurality of planar panels hinged together at their edge-to-edge interface. The contour of the putting surface is selectively changed by tilting one of the panels selectively about the transverse axes, or longitudinal axes or concurrently about both the transverse axis and longitudinal axes of the putting surface. In yet another embodiment, the golf ball putting practice range includes both the transversely, linearly moving golf ball target hole as well as a golf ball return system for returning a golf ball back to the top surface of the putting surface at a position whereat the golfer is standing.

25 Claims, 14 Drawing Figures

GOLF PUTTING PRACTICE APPARATUS

BACKGROUND OF THE INVENTION

The invention relates to golf practice devices, and more particularly to an apparatus for practicing putting.

U.S. Pat. No. 3,831,949 shows a golf putting green made up of a plurality of rectangular, planar floor section with ramp section located between the floor section. Floor section is hinged to ramp section, floor section is hinged to ramp section, floor section is hinged to ramp section, and floor section is hinged to ramp section. Each floor section includes legs for supporting the putting green. By collapsing selected legs, the floor sections and the ramp sections can be oriented at different inclines relative to each other to provide on undulating path for the golf ball. The golf putting green also includes ball deflecting bars which are adjustable to provide obstacles to the golf ball. The position of the deflecting bars is adjustable. A number of golf ball holes are positioned at one end of the putting green. Plugs are removably inserted in selected golf ball holes to allow for changing the location of the one golf ball hole being used as the target.

U.S. Pat. No. 2,871,661 shows a golf putting green made of a flat support base covered by a layer of artificial turf. An undilating surface is provided by bodies which are blocks of wood having curved top surfaces. The bodies are located between the base and artificial turf. the bodies have handles projecting beyond the outer edge of the putting green by which the position of the bodies can be changed. Further, the bodies each have cups into which the ball is to be putted. Selected cups can be covered by plugs to change locations of the target cup.

U.S. Pat. No. 3,892,412 shows a golf putting green formed of a plurality of pads laid end-to-end. The pads can be stacked for storage. Each pad is formed of a base having a top sheet of artificial turf with a plurality of inflatable bags located under the top sheet. The bags are inflated through tubes which extend to the edge of the pad. The pads each include a cup which can be closed by a cover to change locations of the target hole.

U.S. Pat. No. 4,114,887 shows a golf putting green made of a flexible grid layer covered by a fabric layer. The flexible grid layer is made of clip-like grid elements interconnecting transversely extending cross bars. Screw jacks are attached to the flexible grid layer along the longitudinal edges of the grid layer. In addition, a link is pivotally connected to the cross bars and is driven for pivotable motion by a double acting cylinder. As the link is rotated, it bends the cross bar to which it is attached. thus, by activating the jacks, the longitudinal contour of the putting green is changed and by activating the cylinder the transverse contour of the putting green is changed.

U.S. Pat. No. 4,211,417 shows a golf putting green formed of a plurality of planar member of, for example ¾" thick plywood, fastened together at their abutting edges by fasteners of, for example bank steel ¼" thick. A layer of artificial turf overlays the planar members. Lifting devices are located at the intersection of four of the planar members. The lifting devices include a ramp attached to the underside of the planar members at the intersection thereof, and a movable wedge. The wedge is moved toward and away from the ramp by means of a rod which extends outwardly past the periphery edge of the putting green. As the wedge is moved against the ramp it lifts the portions of the planar members to which the ramp is attached, thus, creating a contour putting surface. At least one of the planar members is provided with a cup into which a golf ball is to be putted. The periphery of the putting green is fastened to the base against movement to that the planar members will be distorted upon actuation of the lifting device.

U.S. Pat. No. 4,222,568 illustrates a golf putting green having a flat reinforced section upon which the player stands to putt the golf ball and a bendable section extending from the reinforced section. A hole is formed in the bendable section at the far end thereof from the reinforced section. A ball return chute extends from the hole to a location below the reinforced area. Cross members extend across the putting green under the bendable section and are attached at their opposite ends to the frame. Screw jacks are mounted in the cross members and abut the underside of the bendable section. When the screw jacks are turned they raise or lower local areas of the bendable section creating contours. A rack and pinion arrangement is substituted for the screw jacks. The pinions are turned by means of a shaft which extends outwardly of the edge of the putting green.

U.S. Pat. No. 4,240,637 shows a golf putting green having a putting surface covered with a sheet of fabric. The putting surface is a single sheet of plywood. The plywood surface is supported by height adjustment devices. These height adjustment devices each comprise bolts which extend through captive nuts attached to the plywood surface and engages a nut affixed to the frame. As the bolts are turned by means of handles, they co-act with the captive nuts to raise and lower portions of the plywood surface altering the curvature and/or slope of the putting surface. A hole is formed through the putting surface at one end thereof. Ball return channels are located below the putting surface for returning balls to the opposite end of the putting green.

SUMMARY OF THE INVENTION

It is an object of the present invention to provide a golf ball putting apparatus which includes a movable target hole.

It is another object of the present invention to provide a golf ball putting apparatus which includes a contourable putting surface.

It is yet another object of the present invention to provide a golf ball putting apparatus which further includes a golf ball return system which returns golf balls back to the top of the apparatus for reuse.

More particularly, the present invention, in one embodiment, us a golf ball putting practice range apparatus includes a shooting area upon which a golfer stands when putting a golf ball, a putting surface immediately downrange of the shooting area across which the golfer hits the golf ball, means defining at least one golf ball target hole at the downrange end of the putting surface, and means for selectively moving the golf ball target hole defining means to selectively reposition the golf ball target hole.

In a further embodiment, the putting surface is selectively contourable and includes a plurality of planar sections disposed in adjacent edge-to-edge juxtaposition, hinge means interconnecting the juxtaposed edges of the planar sections so that the planar sections can move relative to each other about their edge-to-edge interface, and the periphery of the putting surface being free to move in a generally vertical direction.

BRIEF DESCRIPTION OF THE DRAWINGS

The various features and advantages of the putting practice apparatus of the present invention are presinled in detail in the following description and accompanying drawing wherein.

DETAILED DESCRIPTION OF THE PREFERRED EMBODIMENT

Figure 1:
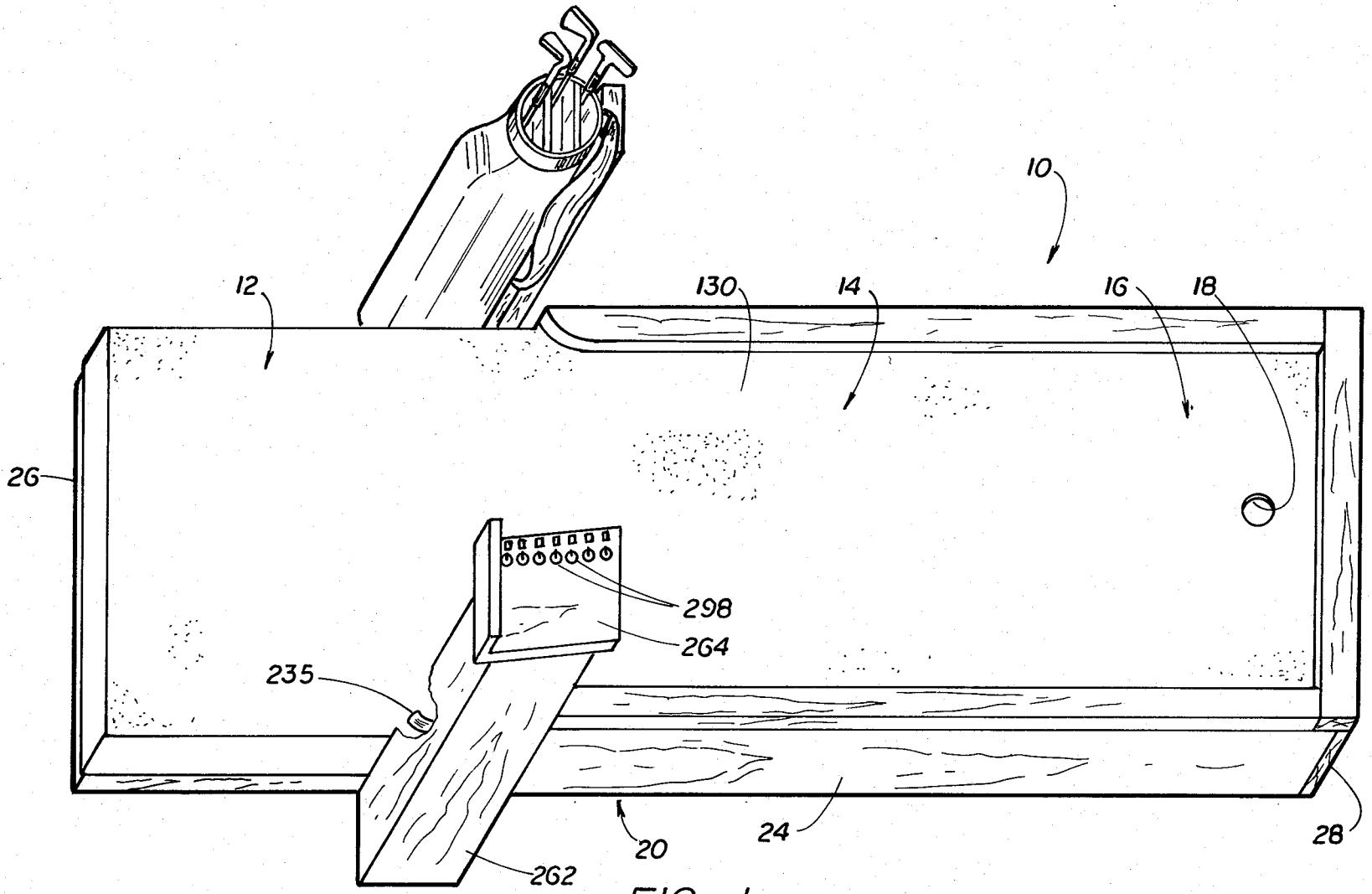
FIG. 1 is a perspective view of the golf putting practice apparatus of the present invention.

FIG. 1 illustrates the golf putting practice apparatus, generally denoted as the number 10, of the present invention. The golf putting practice apparatus is illustrated as comprising three subdivisions: a shooting subdivision, generally denoted as the number 12, the uprange end of the apparatus 10 upon which the golfer putting a golf ball stands; a contourable putting subdivision, generally denoted as the numeral 14, immediately downrange of the shooting subdivision 12 over which the golf ball is rolled; and a target subdivision, generally denoted as the numeral 16, immediately downrange of the contourable putting subdivision 14 having a golf ball receiving hole 18 in which the golfer is attempting to sink the golf ball.

Figure 2:
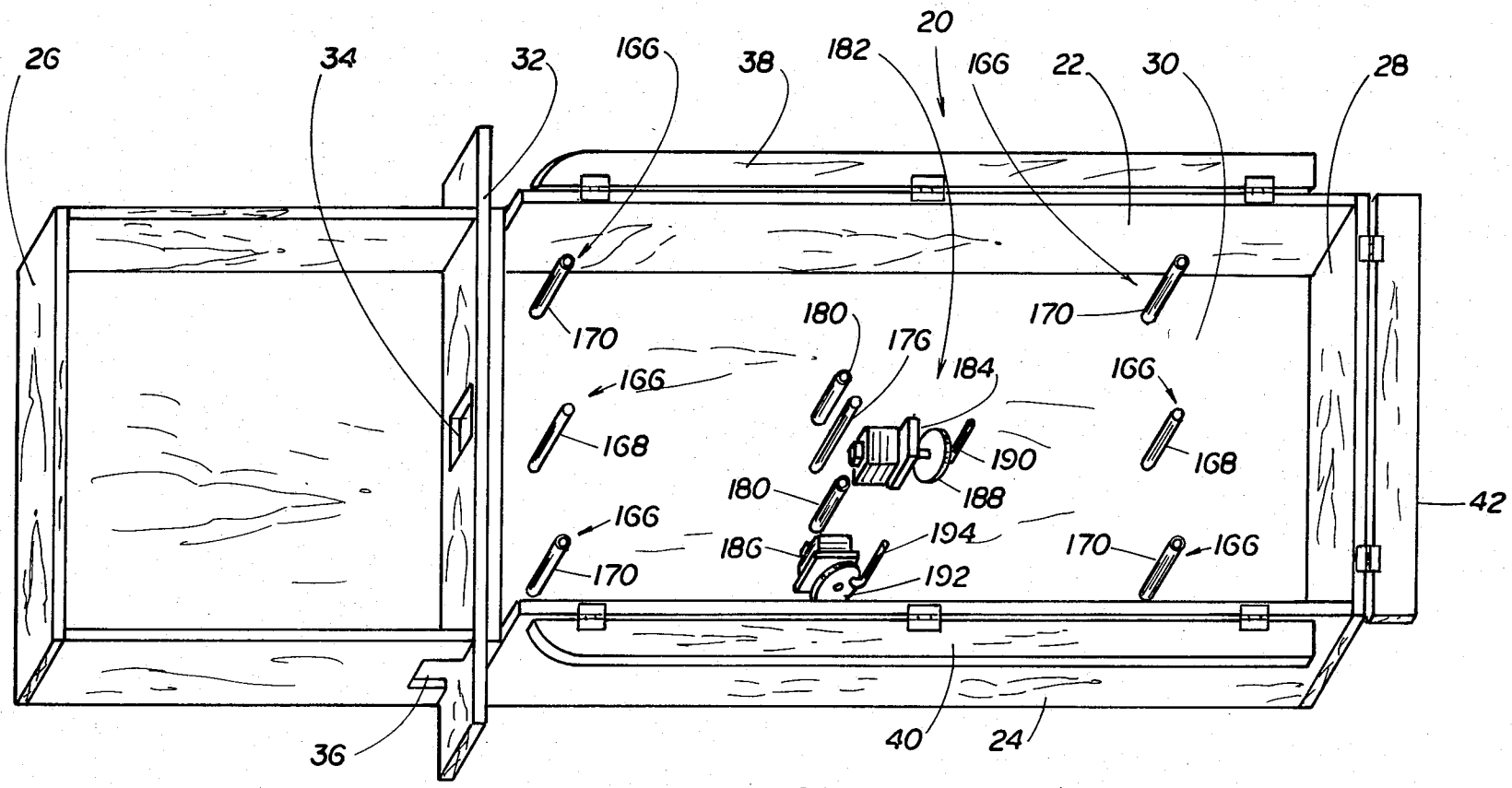
FIG. 2 is a perspective view of the frame structure of the apparatus of FIG. 1.

With reference to FIGS. 1 and 2, the golf putting apparatus 10 includes a peripheral frame structure, generally denoted as the numeral 20. As can be best seen in FIG. 2, the frame structure 20 is shown as having two, parallel, spaced apart side walls 22 and 24, and two, parallel, spaced apart end walls 26 and 28 interconnecting the opposite ends of the side walls 22, 24, and a floor 30. A partition member 32 is located in parallel, spaced apart relationship to the uprange end wall 26. It should be noted here that the portion of the frame side walls 22 and 24 downrange from the partition member 32 are higher than that portion of the frame side walls uprange of the partition member 32, that the downrange end wall 28 is of the same height as the higher portions of the frame side walls, and that the frame uprange end wall 26 is of the same height as the lower portions of the frame side walls. Further, the partition member 32 is of the same height as the uprange end wall 26. The partition member 32 is formed with a hole 34 therethrough centrally located between the frame side walls 22 and 24. In addition, one frame side wall 24 is formed with a hole 36 therethrough to the uprange side of the partition member 32 communicating with the area defined by the frame uprange end wall 26, frame side walls 22, 24, and partition member 32. To the downrange side of the partition member 32, a narrow, elongated trim strip 38 is hinged to the top edge of the frame side wall 22, and a narrow, elongated trim strip 40 is hinged to the top edge of the frame side wall 24. A narrow, elongated trim strip 42 is hinged to the top edge of the downrange end wall 28. These trim strips are foldable over the margin of the area enclosed by the side walls and downrange end wall to give a more finished appearance to the apparatus 10. It has been determined that the frame structure 20 can be conveniently fabricated of wood.

Figure 3:
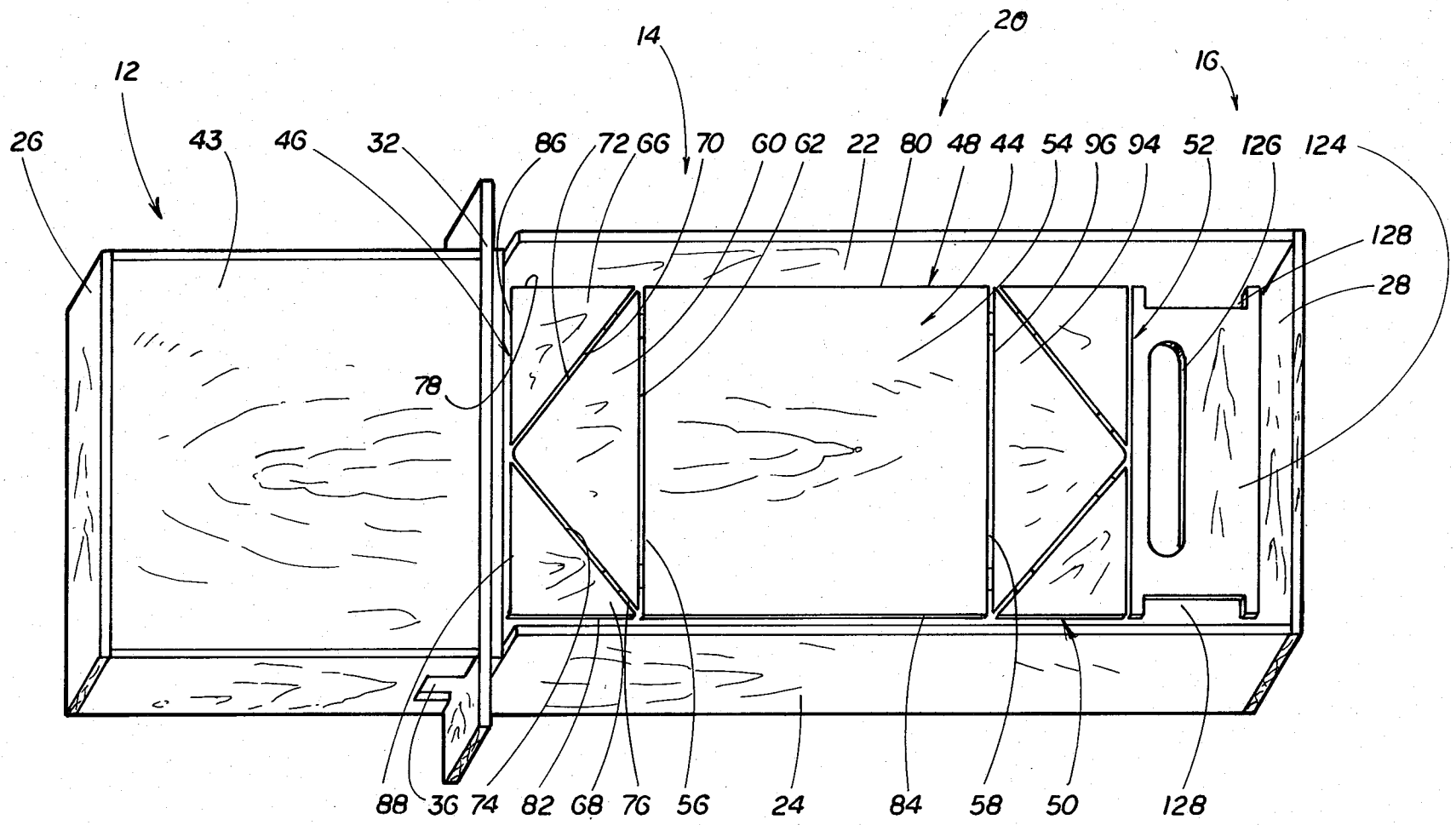
FIG. 3 is a perspective view of the apparatus of FIG. 1 with the top surface removed to show details.

Now with reference to FIG. 3, the shooting subdivision 12 includes a square, horizontal panel 43 enclosing the area of the frame structure 20 defined by the frame uprange end wall 26, frame side walls 22, 24, and partition member 32. The panel 43 is in the plane of the top edges of the frame end wall, frame side walls, and partition member 32, and is attached thereto. The square panel 43 is fabricated of an appropriate material capable of withstanding the weight of a golfer standing thereon. It has been determined that one such suitable material is plywood.

Figure 4:
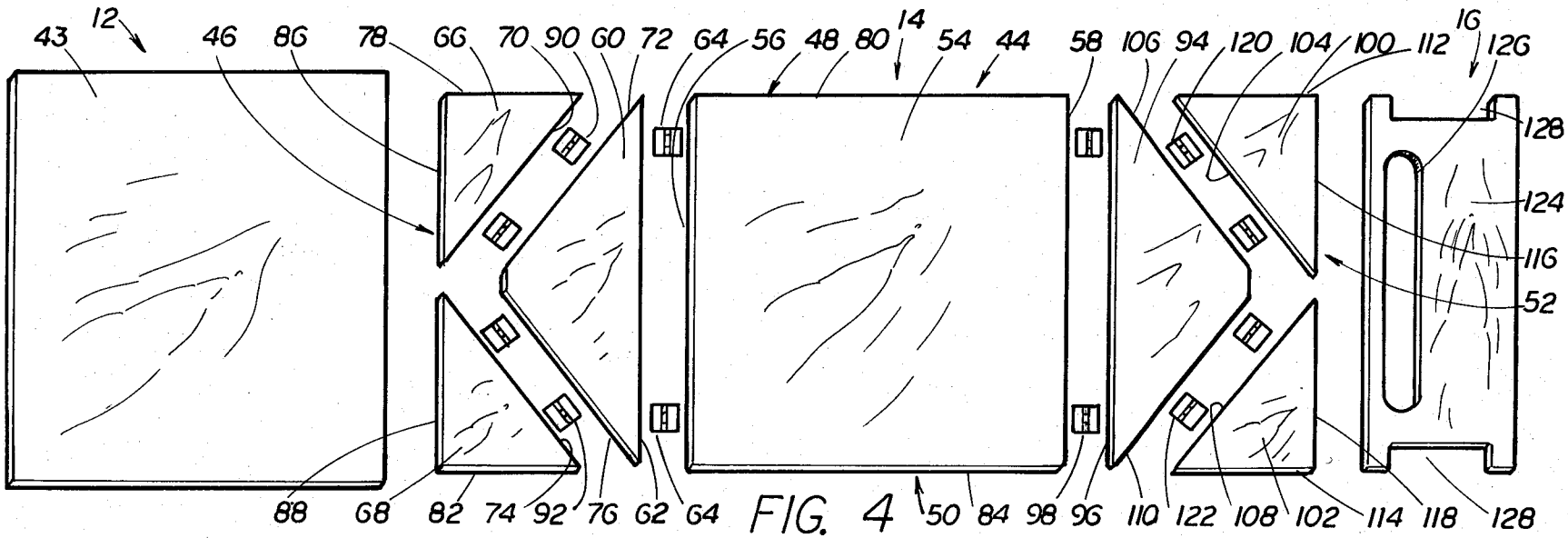
FIG. 4 is an exploded, perspective view of a portion of FIG. 3.

With continued reference to FIG. 3 and additional reference to FIG. 4, the contourable putting subdivision 14 includes a contourable putting surface 44 which is located downrange of the frame partition member 32. The contourable putting surface 44 extends longitudinally of the frame structure 20 from the frame partition member 32 toward the frame downrange end wall 28, but terminates short of the frame downrange end wall 28, and extends transversely of the frame structure 20 from one frame side wall 22 to the other frame side wall 24. Thus, the uprange transverse end 46 of the contourable putting surface 44 is located adjacent to the frame partition member 32, one longitudinal side 48 is located adjacent to the frame side wall 22, the other longitudinal side 50 is located adjacent to the frame side wall 24, and the transverse downrange end 52 is spaced from frame downrange end wall 28. The uprange end 46 of the putting surface 44 is generally in at the height of the frame partition member 32 the longitudinal sides 48 and 50 of the putting surface 44 are located below the top edges of the frame longitudinal sides 48 and 50, and the downrange end 52 of the putting surface 44 is located below the top edge of the frame downrange end wall 28. As illustrated in FIGS. 3 and 4, the contourable putting surface 44 includes a generally rectangular planar center section 54. Center section 54 extends laterally from one frame side wall 22 to the other frame side wall 24. The uprange transverse edge 56 of the center section 54 is located a distance downrange of the frame partition member 32, and the downrange transverse edge 58 of the center section 54 is located a distance uprange of the frame downrange end wall 28. A first isosceles triangularly shaped planar section 60 is located at the uprange edge 56 of the center section 54 with its unequal length side 62 is juxtaposition to the uprange edge 56 of the center section 54 such that the apex of the isosceles triangular section 60 is on the longitudinal center line of the center section 54 and is located at the uprange transverse end 46 of the putting surface 44. The juxtaposed triangular section side 62 and center section uprange edge 56 are hinged together for relative movement by, for example, hinges 64. A pair of first right triangular planar sections 66 and 68 are located to opposite sides of the apex of the isosceles triangular section 60 with the hypotenuse side 70 of the right triangular section 66 in juxtaposition with one of the equal length sides 72 of the isosceles triangular section 60, and with the hypotenuse side 74 of the other right triangular section 68 in juxtaposition with the other equal length side 76 of the isosceles triangular section 60. Thus, one side 78 of the right triangular section 66 is in alignment with one longitudinal edge 80 of the rectangular central section 54, and the one side 82 of the right triangular section 68 is in alignment with the other longitudinal edge 84 of the rectangular central section 54. The other side 86 of the right triangular section 66 and the other side 88 of the right triangular section 68 are in longitudinal alignment with each other and with the apex of the isosceles triangular section 60, and constitute the uprange transverse end 46 of the contourable putting surface 44. The juxtaposed hypotenuse side 70 of right triangular section 66 and equal length side 72 of the isosceles triangular section 60 are hinged together for relative movement by, for example, hinges 90. Similarly, the juxtaposed hypotenuse side 74 of the right triangular section 68 and equal length side 76 of the isosceles triangular section 60 are hinged together for relative movement by, for example, hinges 92. A second isosceles triangularly shaped planar section 94 is located at the downrange edge 58 of the central section 54 with its unequal length side 96 in juxtaposition to the downrange edge 58 of the center section 54 such that the apex of the isosceles triangular section 94 is on the longitudinal centerline of the center section 54 and is located at the downrange transverse end 52 of the putting surface 44. The juxtaposed triangular section side 96 and center section downrange edge 58 are hinged together for relative movement by, for example, hinges 98. A pair of second right triangular planar sections 100 and 102 are located to opposite sides of the apex of the isosceles triangular section 94 with the hypotenuse side 104 of the right triangular section 100 in juxtaposition with one of the equal length sides 106 of the isosceles triangular section 94, and with the hypotenuse side 108 of the other right triangular section 102 in juxtaposition with the other equal length side 110 of the isosceles triangular section 94. Thus, one side 112 of the right triangular section 100 is in alignment with the longitudinal edge 80 of the rectangular central section 54, the one side 114 of the right triangular section 102 is in alignment with the other longitudinal edge 84 of the rectangular central section 54. The other side 116 of the right triangular section 100 and the other side 118 of the right triangular section 102 are in longitudinal alignment with each other and with the apex of the isosceles triangular section 94, and constitute the downrange transverse end 52 of the contourable putting surface 44. The juxtaposed hypotenuse side 104 of the right triangular section 100 and equal length side 106 of the isosceles triangular section 94 are hinged together for relative movement by, for example, hinges 120. Similarly, the juxtaposed hypotenuse side 108 of the right triangular section 102 and the equal length side 110 of the isosceles triangular section 102 are hinged together for relative movement by, for example, hinges 122. It has been found advantageous to fabricate the central rectangular section and all of the triangular sections of the contourable putting surface 44 of plywood.

With reference to FIG. 1, the square panel 43 of the shooting subdivision 14 and the contourable putting surface 44 of the putting subdivision 14 are covered with a continuous sheet of fabric covering 130. This fabric covering 130 can be of virtually any type and, preferably, a type which imitates grass such as, for example, outdoor carpeting, artificial turf and the like.

With continued reference to FIGS. 3 and 4, the target subdivision 16 comprises a generally planar panel 124 which is located in the space between the downrange end 52 of the contourable putting surface 44 and the uprange frame end wall 28. The planar panel 124 is substantially horizontal, and is located below the top edges of the frame side walls 22, 24 and top edge of the downrange end wall 28 by amount generally equal to the distance by which the contourable putting surface 44 is located below the frame side walls 22, 24 when it is in a flat configuration. Further, the planar panel 124 is generally coplanar with the square panel 43 of the shooting subdivision 12. The planar panel 124 is formed with an elongated slot 126 therethrough having its elongated axis generally transverse to the longitudinal axis of the contourable putting surface 44. The width of the elongated slot is greater than the diameter of a golf ball. Preferably, the elongated slot 126 is symetrically located to the longitudinal center line of the contourable putting surface 44.

With reference to FIG. 3, the transverse edge of the planar panel 143 adjacent the downrange frame end wall 28 by a distance somewhat larger than the diameter of a golf ball. The planar panel 28 can be attached to the frame side walls 22 and 24. The planar panel 124 is also formed with two clearance slits 128 at its opposite ends located at the frame side walls 22 and 24 for reasons as will be fully explained hereinafter. It has been found advantageous to fabricate the planar panel of plywood.

Figure 5:
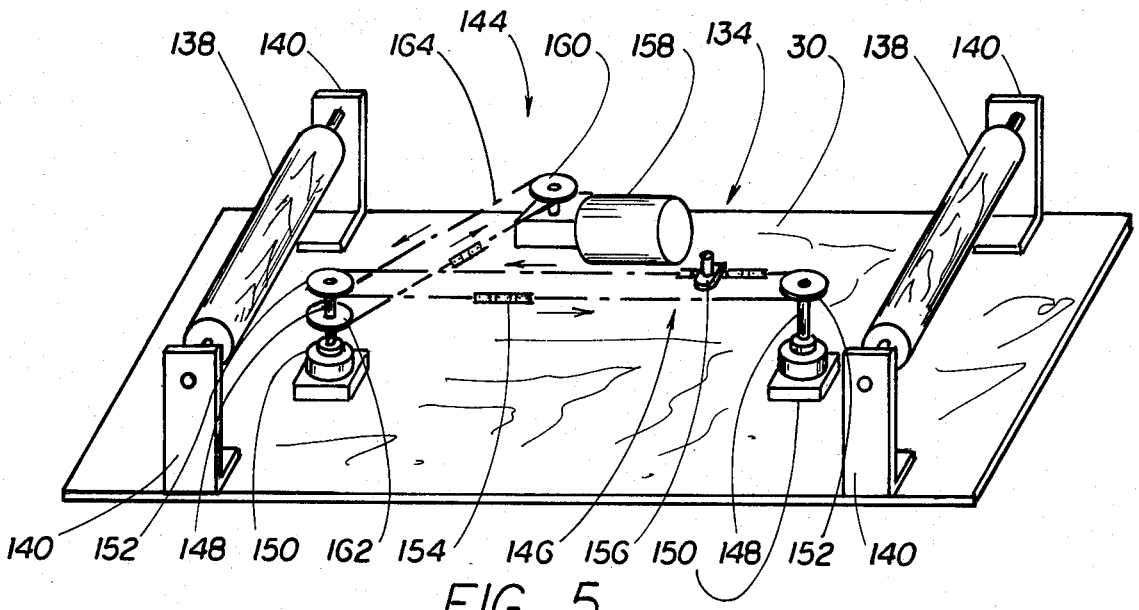
FIG. 5 is a perspective view of a component of the present invention with portions thereof removed away to show details.
Figure 6:
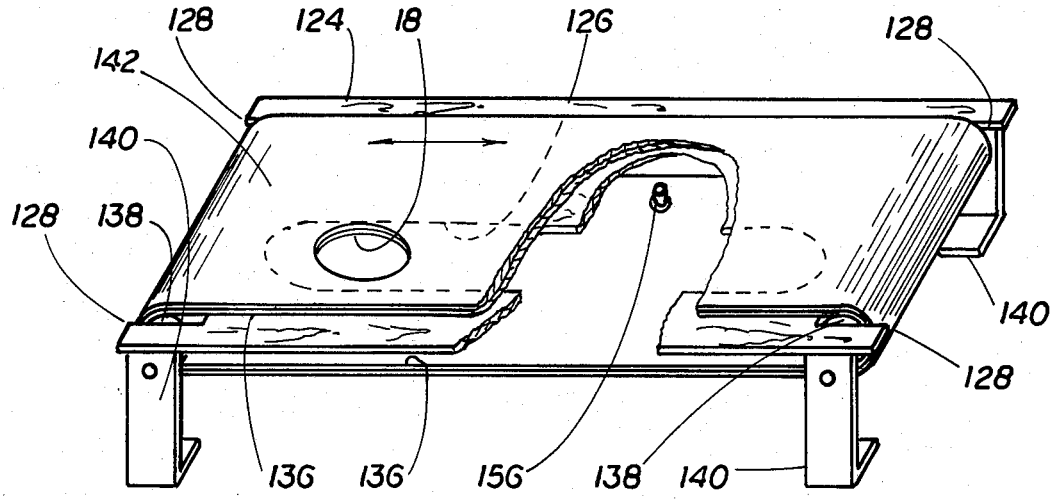
FIG. 6 is a perspective view of the component of FIG. 5 with the portions which were removed included, but with portions broken away to more clearly show details.

Referring more particularly to FIGS. 5 and 6, the target subdivision 16 includes golf ball target hole moving means, generally denoted as the numeral 134 which includes an endless belt 136 trained about a pair of horizontal, spaced apart, parallel rollers 138. The rollers 138 are supported above the frame floor 30 by means of brackets 140. The endless belt 136 is oriented for movement transverse to the longitudinal axis of the contourable putting surface 44 as indicated by the double headed arrow in FIG. 6. A length of fabric 142 covers the exterior surface of the endless belt 136. The fabric covering 142 can be of virtually any type, and is preferably the same as the fabric covering 130 over the shooting subdivision 12 and putting subdivision 14. The single golf ball target hole 18 is defined by a hole formed through the top flight of the endless belt 136 and a like hole in the fabric 142 in mutual registration. As can be best seen in FIG. 5, the endless belt 136 is moved back and forth transversely to the contourable putting surface 44 by drive means, generally denoted as the numeral 144. The belt drive means 144 includes an endless chain mechanism 146 including two parallel, spaced apart vertical shafts 148 attached to the frame floor 30 by journals 150. The endless chain mechanism 146 is located beneath the bottom flight of the endless belt 136, and the shafts 148 are spaced apart along the longitudinal axis of the endless belt 136. Chain drive sprockets 152 are attached to the shafts 148 and an endless driven chain 154 is trained about the sprockets 152 such that the chain flights are parallel to the longitudinal axis of the endless belt 136. A belt engagement spindle 156 is attached to one of the chain flights and extends vertically upwardly toward the bottom flight of the endless belt 136. The spindle 156 is off-set from the chain flight to which it is attached such that is lays on the longitudinal center line between the two parallel chain flight of the endless driven chain 154. Therefore, as the endless driven chain 154 moves about the sprockets 152, as indicated by the arrows in FIG. 5, the spindle 156 moves back and forth between the sprockets 152 along the longitudinal centerline between the chain flights. The belt drive means 144 further includes a driving motor 158, such as a fractional horsepower electric motor, mounted to the frame floor 30 next to the endless chain mechanism 144. A driving sprocket 160 is attached to the output shaft of the motor 158, and a driven sprocket 162 is attached to one of the shafts 148 of the endless chain mechanism 144. A drive chain 164 is trained about the driving sprocket 160 and driven sprocket 162. Thus, as the motor 158 is energized the drive chain 164 moves as indicated by the arrows in FIG. 5 causing the endless driven chain 154 to also move about sprockets 152 as indicated by the arrows in FIG. 5.

Now with reference to FIG. 6, the lower flight of the endless belt 136 is formed with an appropriate aperture through which the vertical spindle 156 of the endless driven chain 154 is received. Therefore, as the spindle 156 moves back and forth between the sprockets 152, the endless belt 136 is caused to also move back and forth transversely of the longitudinal axis of the contourable putting surface 44 resulting in movement of the golf ball target hole 18 also transversely of the longitudinal axis of the contourable putting surface 44. The planar rectangular panel 124 of the target subdivision 16 is positioned beneath the top flight of the endless belt 136 with the longitudinal axis of the elongated slot 126 in alignment with the center of the golf ball target hole 18 such that the golf ball target hole 18 remains in registration with the elongated slot 126 as the golf ball target hole 18 moves transversely. The clearance slits 128 at the opposite ends of the planar panel 124 provide for the passage of the endless belt 136.

Figure 7:
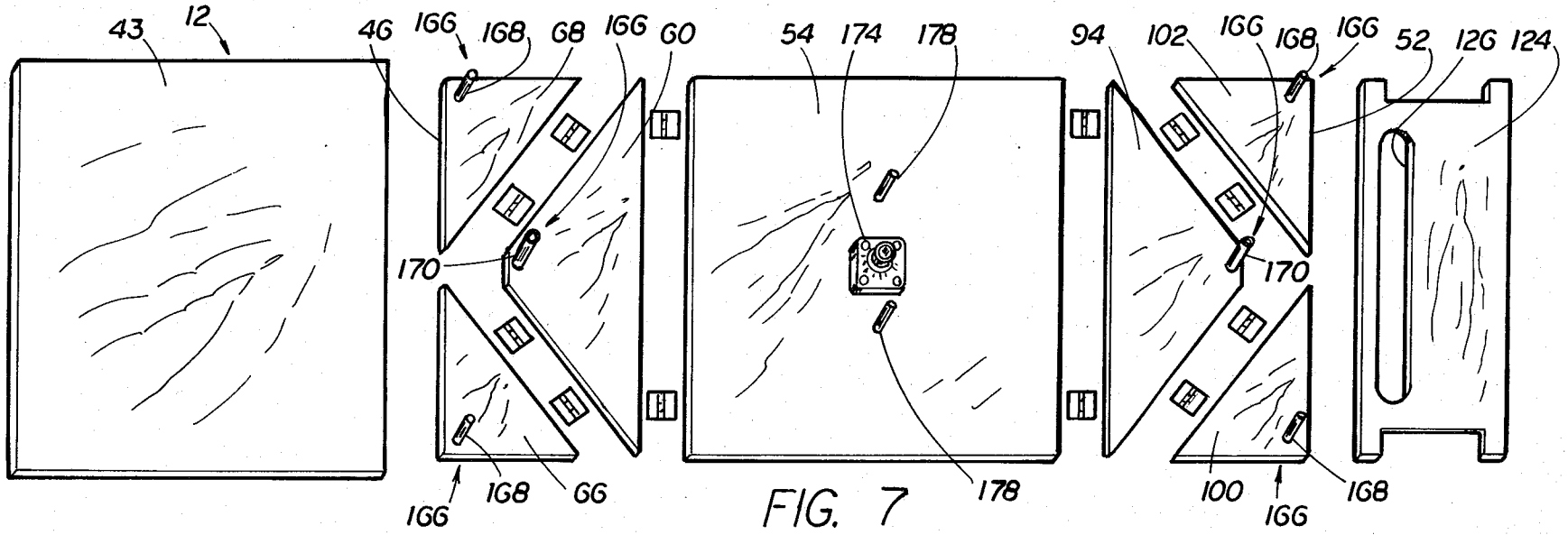
FIG. 7 is a perspective view of the underside of the component of FIG. 4.
Figure 8:
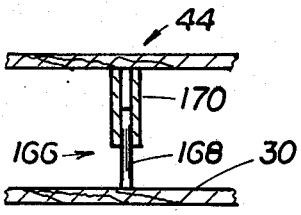
FIG. 8 is an enlarged cross-sectional view of another component of the present invention.

Now with reference once again to FIG. 2, and additional reference to FIGS. 7 and 8, there is illustrated the means for supporting the contourable putting surface 44 in the frame structure 20 and allowing the contour of the putting surface 44 to be selectively changed. The putting surface support means comprises flexible connections, generally denoted as the numeral 166 located at each corner and at the midpoint of the uprange transverse end 46 and downrange transverse end 52 of the contourable putting surface. The flexible connector 166 located at each corner of the contourable putting surface 44 is shown as including a rigid pin 168 (see FIG. 7) depending from the underside of the contourable putting surface 44, and a flexible tube member 170 extending vertically upwardly from the frame floor 30 in generally coaxial alignment with the rigid pin 168 so that the rigid pin 168 is received in the bore of the flexible tube 170 as seen in FIG. 8. It should be understood that the positions of the pin 168 and tube 170 could be reversed such that the flexible tube member 170 could be attached to the contourable putting surface 44 to depend therefrom and that the rigid pin 168 could extend vertically upwardly from the frame floor 30.

As shown in FIG. 7, a different one of the four rigid pins 168 is attached to the underside of each of the two first right triangular sections 66, 68 and each of the two second right triangular sections 100, 102 of the putting surface 44 proximate the right angle corner thereof. The flexible connector 166 located at the midpoints of the uprange end 46 and downrange end 48 of the putting surface 44 is shown as each including a flexible tube member 170 depending from the underside of the contourable putting surface 44, and a rigid pin 168 extending vertically upwardly from the frame floor 30 in general coaxial alignment with the flexible tube member 160 so that the rigid pin 168 is received in the bore of the flexible tube 170. The positions of the rigid pin 168 and flexible tube member 170 could also be reversed as mentioned above. As shown in FIG. 7, a flexible tube member 170 is attached to the underside of each of the first and second isosceles triangular sections 60 and 94 proximate the apex thereof.

Figure 9:
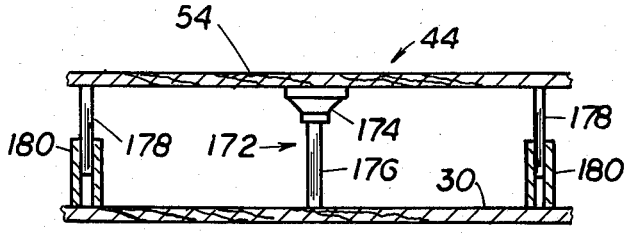
FIG. 9 is an enlarged cross-sectional view of yet another component of the present invention.

With reference to FIGS. 2, 7 and 9, the putting surface support means further includes bearing support means, generally denoted as the numeral 172, which includes a self aligning bearing 174 attached to the underside of the putting surface 44 at the geometric center thereof, and a vertical bearing support post 176 extending upwardly from the frame floor 30 affixed at its top end to the self aligning bearing 174. Two stabilizing means are also provided and are shown as comprising a pair of rigid pins 178 depending from the underside of the putting surface 44 and equally spaced to opposite sides of the self-aligning bearing 174 transversely of the longitudinal centerline of the putting surface 44, and a pair of tubular members 180 vertically extending upwardly from the frame floor 30 in coaxial alignment with the pair of rigid pins 178 such that the pins 178 are each received in the bore of a different one of the tubular members 180 for telescopic movement therein (see FIG. 9). As can be seen in FIG. 7, the self-aligning bearing 174 is attached to the geometric center of the underside of the rectangular center section 54 and the depending pins 178 are attached to the underside of the rectangular center section 54 to either side of the self-aligning bearing 174.

Figure 11:
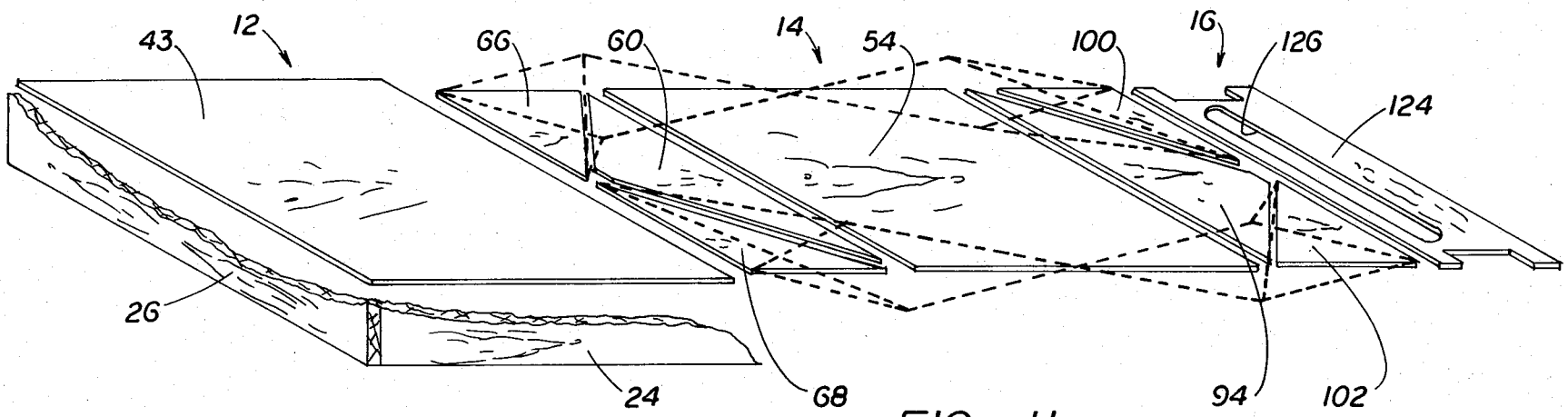
FIG. 11 is another perspective view of the putting practice apparatus illustrating additional obtainable contours.
Figure 10:
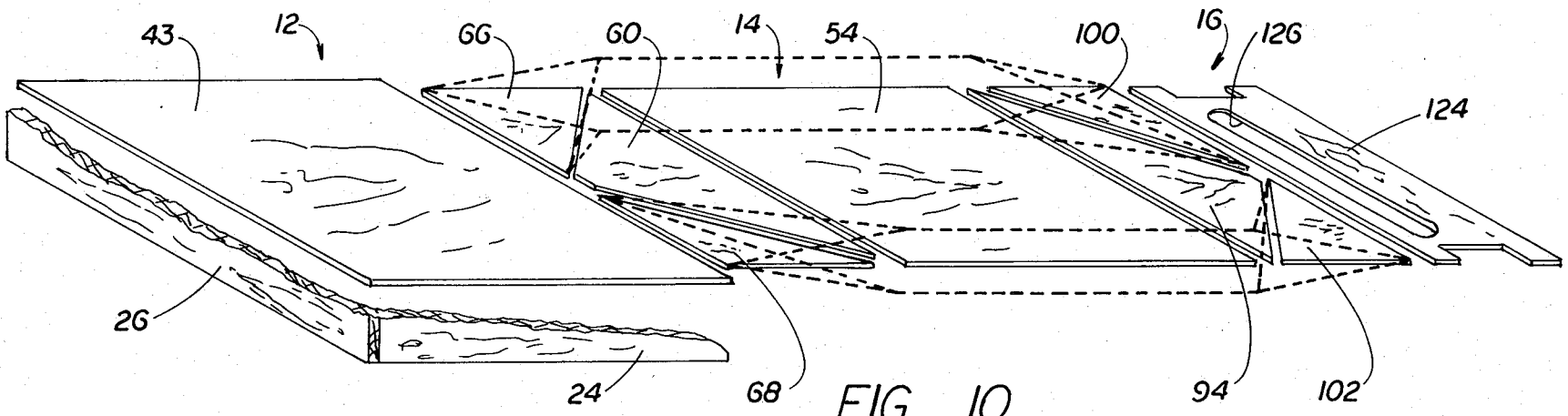
FIG. 10 is a perspective view of the putting practice apparatus illustrating different obtainable contours.

Referring now to FIG. 2, the golf putting practice apparatus 10 further includes means, generally denoted by the numeral 182, for selectively changing the contour of the putting surface 44 by causing the rectangular center section 54 and various triangular sections 60, 66, 68, 94, 100, 102 to move relative to each other about their hinged juxtaposed edges. As shown, the contour changing means includes a first motor 184 operatively associated with the rectangular center section 54 of the putting surface to tilt the center section 54 about the longitudinal center line of the putting surface 44 to change the left and right or lateral slope and grade of the putting surface 44, and a second motor 186 operatively associated with the rectangular center section 54 of the putting surface to tilt the center section 54 about the transverse centerline of the putting surface to change the longitudinal slope and grade of the putting surface 44. As shown, the first motor 184 includes a cam 188 attached to its output shaft. The cam 188 is operatively associated with the rectangular center section 54 by a follower arm 190 connected to the underside of the rectangular center section 54 to one side of the longitudinal centerline of the putting surface 44. Thus, as the motor 184 is actuated, the cam 188 rotates with the motor output shaft and the planar center section 54 is caused to tilt about the self-aligning bearing 174 by the cam follower arm 190 as dictated by the development of the cam 188. Similarly, the second motor 186 includes a cam 192 attached to its output shaft. The cam 192 is operatively associated with the rectangular center section 54 by a follower arm 194 connected to the underside of the rectangular center section 54 to one side of the transverse centerline of the putting surface 44. Thus, as the motor 186 is actuated, the cam 192 rotates with the motor output shaft and the planar center section 54 is caused to tilt about the self-aligning bearing 174 by the cam follower arm 194 as dictated by the development of the cam 192. The first and second motors 184, 186 can be, for example, fractional horsepower electric motors. As the center section 54 is caused to tilt about the transverse and longitudinal center lines of the putting surface, the flexible connectors 166 support the various triangular sections of the putting surface 44 while allowing relative movement of the various triangular sections and center section about their hinge connections. FIG. 10 illustrates in broken lines various left or right slopes and grades adopted by the contourable putting surface 44 as the first motor 184 is actuated, and FIG. 11 illustrates in broken lines various longitudinal slope and grades adopted by the contourable putting surface 44 as the second motor 186 is actuated. It should be understood that both the first and second motors 184 and 186 can be actuated simultaneously, individually or sequentially so that both the lateral and longitudinal slopes and grades of the center section 54 can be concurrently changed which results in a literally thousands of different putting surface contours.

Figure 12:
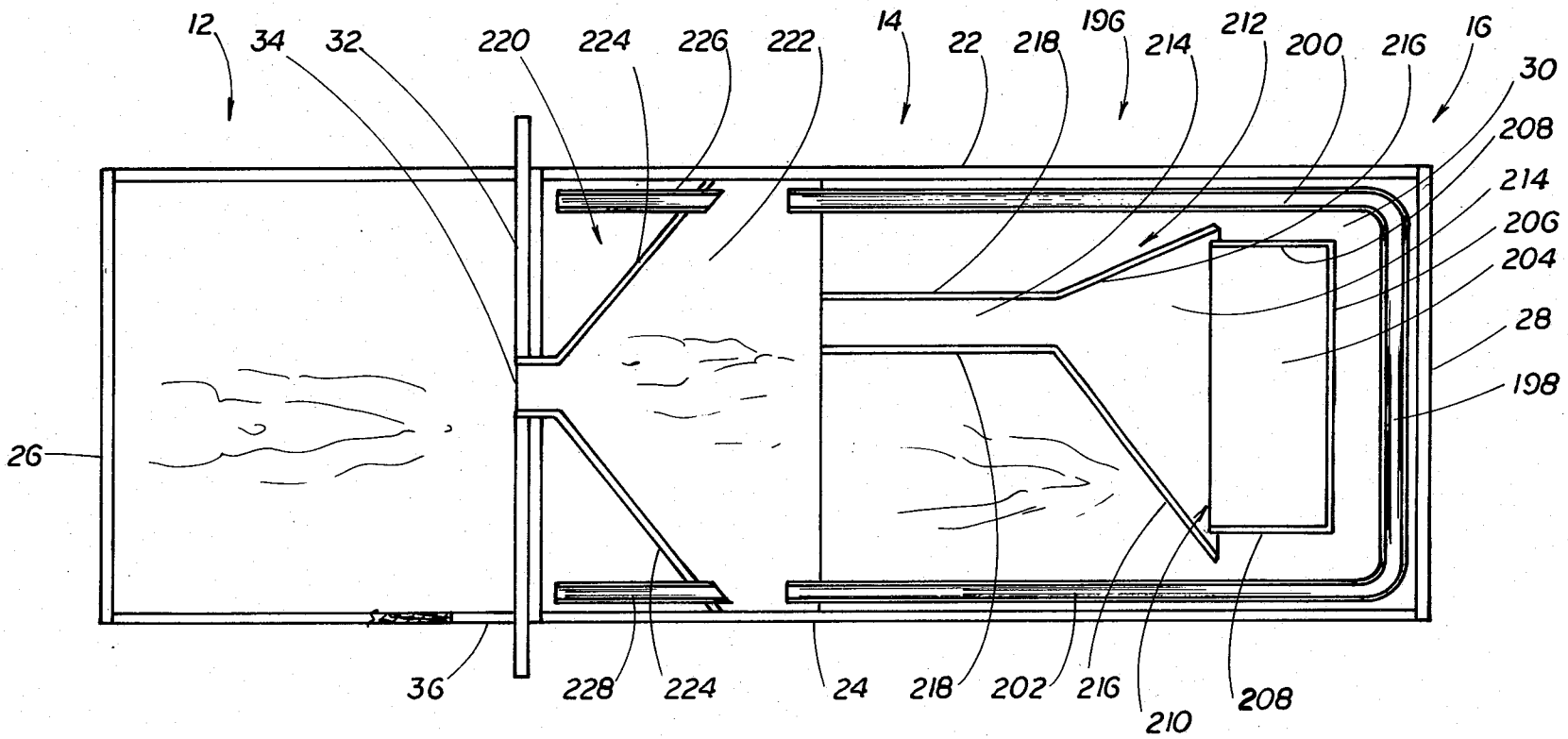
FIG. 12 is a plan view of the putting practice apparatus with putting surface removed to show details of a portion of a golf ball return system.

Now referring to FIG. 12, there is shown a golf ball return system, generally denoted as the numeral 196, provided by the present invention. The golf ball return system 196 comprises a transverse golf ball trough 198 located above the frame floor 30 along the frame downrange end wall 28 such that this transverse trough 198 is located below the opening between the downrange edge of the planar panel 124 of the target subdivision 16 and the frame downrange end wall 28. The transverse trough 198 slopes downwardly from its longitudinal midpoint toward the opposite frame side walls 22 and 24. A first longitudinal golf ball trough 200 is located next to the frame side wall 22 and has its downrange end in communication with the lower end of the transverse trough 198. at the intersection of the frame end wall 28 and frame side wall 22. The first longitudinal trough 200 slopes downwardly therefrom in the uprange direction and terminates at an upon end a distance downrange of the frame partition member 32. Similarly, a second longitudinal golf ball trough 202 is located next to the other frame side wall 24 and has its downrange end in communication with the lower end of the transverse trough 198 at the intersection of the frame end wall 28 and frame side wall 24. The second longitudinal trough 202 slopes downwardly therefrom in the uprange direction and terminates at an open end a distance downrange of the frame partition member 32. An open topped pan 204 is above the frame floor 30 below the elongated slot 126 of rectangular panel 124 of the target subdivision 16. The pan 204 has a back wall 206, two side walls 208 and is oriented with its open side 210 facing uprange. A first gutter, generally denoted as the numeral 212, is to open to the open side 210 of the pan 214. The first generally y-shaped gutter 212 is formed of a floor 214 which slopes downwardly from the open trough side 210 in an uprange direction and terminates a distance downrange of the frame partition member 32 approximately in line with the open ends of the first and second longitudinal troughs 200 and 212. The first gutter 212 further includes two converging side walls 216 which converge from the opposite pan side walls 208 in an uprange direction toward the frame partition member 32. The convergent ends of the converging gutter side walls 216 are spaced apart by a distance approximately equal to a golf ball diameter. Two generally parallel gutter side walls 218 extend from the convergent ends of the converging side wall 216 to the uprange end of the sloping gutter floor 214 forming an open outlet end approximately in line with the open outlet ends of the first and second longitudinal troughs 200 and 212. A second converging gutter, generally denoted as the numeral 220, is formed with a floor 222 which slopes downwardly from a location at the open outlet ends of the first gutter 212 and first and second longitudinal troughs 200 and 212 to the frame partition member 32. The second gutter includes two converging side walls 224 which extend in converging relationship from the frame side walls 22 and 24 uprange of the open outlet ends of the first gutter 212 and longitudinal troughs 200 and 212 to the hole 34 through the frame partition member 32. The convergent ends of the gutter side walls 220 are spaced apart by a distance substantially equal to the width of the partition member hole 34 defining a golf ball outlet in communication with the partition member hole 34. In addition, a third longitudinal trough 226 extends from the intersection of the frame side wall 22 and frame partition member 32 along the frame side wall 22 and over one of the converging side walls 224 of the second gutter 220 terminating in an open outlet end inside the confines of the second gutter 220. Similarly, a fourth longitudinal gutter 228 extends from the intersection of the other frame side wall 24 and frame partition member 30 along the frame side wall 24 and over the other one of the converging side walls 224 of the second gutter 220 terminating in an open outlet end inside the confines of the second gutter 220. Thus, it can be seen that any ball which may miss the target hole 18 and falls downwardly through the space between the downrange edge of the panel 124 and the frame downrange end wall 28 will be collected by the transverse trough 198 and be routed to either of the first or second longitudinal troughs 200 or 212 which delivers the golf ball to the second gutter 220. Any golf ball which falls through the target hole 18 will be collected in the pan 204 and be routed through the first gutter 212 to the second gutter 220. Any golf balls which may somehow fall downward between the longitudinal sides 48 and 50 of the putting surface 44 and frame side walls 22 and 24, respectively, will be collected in the longitudinal troughs 200, 202, 226 or 228 and routed to the second gutter 220. The second gutter 220, in turn, routes all of the golf balls through the hole 34 in the frame partition member 30.

Figure 13:
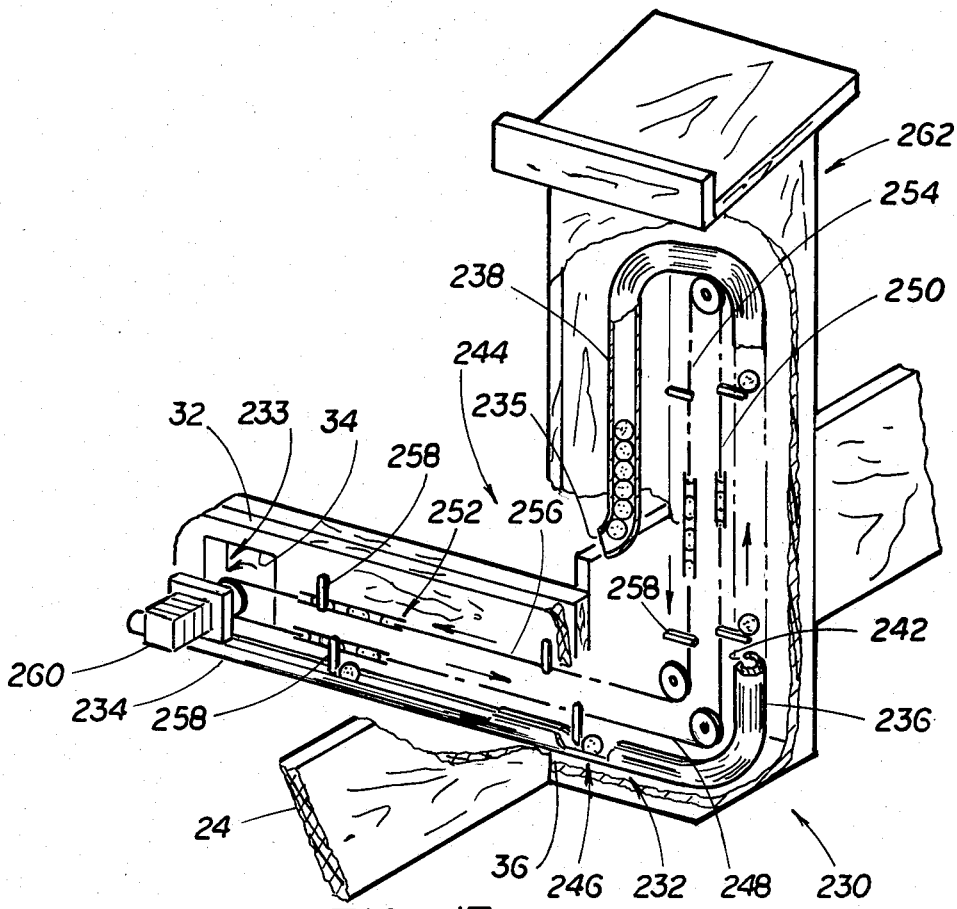
FIG. 13 is a perspective view of another portion of the golf ball return system with portions broken away to clearly show details; and, FIG. 14 is a perspective view of the downrange end of the putting practice apparatus of FIG. 1 with portions removed to more clearly show details.

Now referring to FIGS. 1 and 13, the golf ball return system 196 further includes a golf ball dispensing apparatus, generally denoted as the numeral 230, for receiving returned golf balls from the second gutter 220 and dispensing the golf balls to the top surface of the shooting subdivision 12. The golf ball dispensing apparatus 230 is shown as having a golf ball guide way generally denoted as the numeral 232 which has an inlet end 233 in communication with the hole 34 through the frame partition member 32 at the other side of the hole 34 from the convergent ends of the second gutter 220, and an outlet end 235 at the top surface of the shooting subdivision 12. The golf ball guide way 232 is shown as having an open topped trough section 234 extending from the partition member hole 34 longitudinally along the partition member 32 through the hole 36 in the frame side wall 24, a first vertical tubular section 236 which extends upwardly from the trough section end extending through the frame side wall hole 36, and a second vertical tubular section 238 which extends downwardly from the top end of the first tubular section 236 in parallel, spaced apart relationship thereto and terminates at an open golf ball outlet end 235 at the top surface of the shooting subdivision 12. The first vertical tubular section 236 has slot 242 extending its entire length. The golf ball dispensing apparatus 230 further includes golf ball moving means, generally denoted as the numeral 244, which moves retrieved golf balls along the trough section 234, and up the first vertical tubular section 236 of the golf ball guide way 232. The golf ball moving means 244 is shown as an endless chain device having ball moving flight 246 with a length 248 parallel to the trough section 234 and another length 250 parallel to the first vertical tubular section 236 of the guide way 232. The return flight 252 of the endless chain 244 is shown as having a length 254 parallel to the vertical length 250 of the ball moving flight 246 and a length 256 parallel to the horizontal length 248 of the ball moving flight 246. The vertical length 250 of the ball moving flight 246 and the vertical length 254 of the return flight 252 are located in the space between the first and second parallel vertical sections 236 and 238 of the guide way 232. The endless chain 244 includes a plurality of golf ball engagement paddles 258 at spaced apart intervals therealong. The paddles 258 moving with the ball moving flight 246 extend downwardly into the open topped trough section 235 and through the slot 242 into the first vertical tubular section 236. As the endless chain 244 moves, the paddles 258 contact any balls in the open topped trough section 234 and move them therealong and upwardly in the first vertical tubular section 236 of the guide way 232. At the top end of the first vertical tubular section 236, the length 252 of the chain return flight 252 moves away from the guide way 232 causing the paddles 258 to retract from the first vertical tubular section 236 just as the golf balls enter the top end of the second vertical tubular section 238. The golf balls then fall by gravity through the second vertical tubular section 238 and exit therefrom through the open golf ball outlet end 235 on to the top surface of the shooting subdivision 12. The endless chain device 244 can be powered by a motor 260, such as a fractional horsepower electric motor. The vertical first and second tubular sections 234 and 236 of the ball guide way 232, and the vertical lengths 250 and 254 of the endless chain 244 are enclosed in a pedestal 262 which is attached to the frame side wall 24 and terminates at an elevation above the top side of the shooting subdivision 12. The top of the pedestal 262 can be equipped with a top 264 for holding, for example, a score card.

Figure 14:
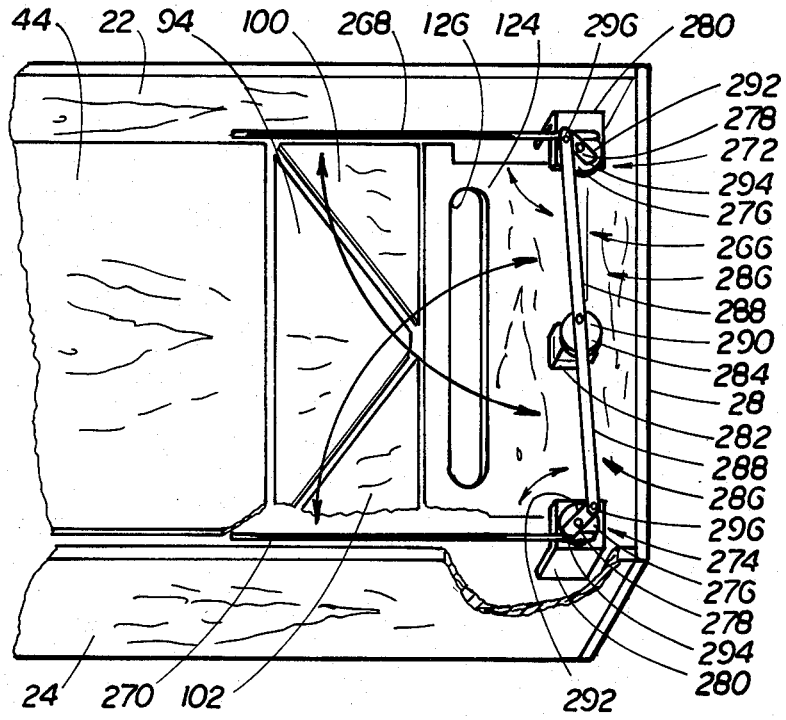

With reference to FIG. 14, the putting practice apparatus 10 further includes golf ball sweeping means, generally denoted as the numeral 266 for selectively sweeping any golf balls which have come to rest on the putting surface to the space between the downrange end of the planar panel 124 of the target subdivision 16 and frame downrange end wall 28 so that they will be returned to the top surface of the shooting subdivision 12 as described above. The sweeping means 266 is shown as comprising two pivotable arms 268 and 270 which move over the putting surface from a stored location next to the frame side walls 22 and 24 (as shown in solid lines in FIG. 14) over the putting surface in an arcuate path (as indicated by the arrows) toward the frame downrange end wall 28. As shown, the sweep arm 268 is mounted at one of its ends to a pivot 272 located at the corner defined by the intersection of the frame side wall 22 and frame downrange end wall 28, and the sweep arm 270 is mounted at one of its ends to a pivot 274 located at the corner defined by the intersection of the other frame side wall 24 and frame end wall 28. Each of the pivots 272 and 274 are identical, and each is formed of a different circular driven disc 276 mounted for rotation about its central axis 278 on brackets 280 located at the above mentioned frame corners. The sweep arms 268 and 270 are each mounted eccentrically to its respective circular driven disc 276. The discs 276 are caused to simultaneously move about their central axis by means of a motor 282, such as a fractional horsepower electric motor. A driving disc 284 is centrally mounted to the output shaft of the motor 282 for rotation therewith. The driving disc 284 is operatively connected to each of the driven discs 276 by identical two bar link arrangements, generally denoted as the numeral 286. Each link arrangement 286 comprises a first bar 288 is pivotally connected on one of its ends 290 to the driving disc 284 eccentrically thereto, and a second bar 292 mounted at one of its ends 294 at the pivot axis 278 of the driven disc 276 for rotation therewith. The distal ends of the first and second bars 288 and 292 are interconnected by a pivot pin 296. Thus, as the driving disc 284 is cause to rotate through 360 degrees with the motor output shaft, each of the driven discs 276 oscillates through approximately a 90 degree arc moving the sweep arms 268 and 270 in an arcuate path back and forth between the frame side walls 22 and 24, respectively, and frame downrange end wall 28. Preferably, the arms 268 and 270 are of such a length, for example, longer than one-half the width of the putting surface 44, as to have the free ends overlap each other as they move over the putting surface.

All of the drive motors 158, 184, 186, 260 and 282 can be connected through appropriate circuitry (not shown) to manually operate switches 298 conveniently located in the pedestal top 264 for selected operation by a golfer standing on the shooting subdivision 12.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A golf ball putting practice range apparatus comprising:

a shooting area upon which a golfer stands when putting a golf ball;

a putting surface immediately downrange of the shooting area across which the golfer hits the golf ball;

Means defining at least one golf ball target hole at the downrange end of the putting surface selectively movable in a straight line transversely of the longitudinal axis of the putting surface; and means for selectively repositioning the golf ball target hole transversely of the longitudinal axis of the putting sufrace.

2. The putting practice range apparatus of claim 1, wherein the target hole moving means comprises endless belt means having a top flight generally in line with the putting surface, the at least one golf ball target hole being formed in the top flight.

3. The putting practice range apparatus of claim 2, wherein the endless belt means comprises drive means for causing the top belt flight to selectively move back and forth motion and, thereby, causing the golf ball target hole also to move back and forth generally transverse to the longitudinal axis of the putting surface.

4. The putting practice range apparatus of claim 3, wherein the belt drive means comprises:

an endless driven chain having its chain flights generally parallel to the longitudinal axis of the direction of movement of the endless belt top flight; and, means engaging one of the endless chain flights to the bottom flight of the endless belt.

5. The putting practice range apparatus of claim 1, further comprising golf ball return means located beneath the golf ball target hole defining means and beneath the putting surface for returning golf balls to the top surface of the shooting area.

6. The putting practice range apparatus of claim 5, wherein the golf ball return means comprises golf ball dispensing means for raising returned golf balls to the top surface of the shooting area.

7. The putting practice range apparatus of claim 6, wherein the golf ball dispensing means comprises:

golf ball guide way means for guiding the returned golf balls to a location at the top surface of the shooting area; and, golf ball moving means for moving the returned golf balls along the path defined by the guide way means.

8. The putting practice range apparatus of claim 5, further comprising means for selectively sweeping golf balls from the putting surface and into the golf ball return means.

9. The putting practice range apparatus of claim 8, wherein the golf ball sweeping means comprises at least one sweep arm adapted for selected movement over at least a portion of the putting surface to contact golf ball resting thereon.

10. The putting practice range apparatus of claim 9, wherein the at least one sweep arm is mounted at one of its ends for pivotable movement in an arc over the top surface of at least a portion of the putting surface.

11. The putting practice range apparatus of claim 9, wherein the golf ball sweeping means further comprises sweep arm moving means located beneath the putting surface for selectively moving the sweep arm over the putting surface.

12. The putting practice range apparatus of claim 5, further comprising means defining a space downrange of the target hole for allowing putted golf balls which have missed the target hole to fall into the ball return means.

13. The putting practice range apparatus of claim 1, wherein the putting surface comprises means providing for changing the contour of the putting surface.

14. The golf ball putting practice range apparatus of claim 13, further comprising means for selectively causing the contour of the putting surface to change its contour located beneath the contourable putting surface.

15. The golf ball putting practice range of claim 14, wherein the means for causing the contour of the putting surface to change comprises at least one cam and a cam follower interconnecting the cam and putting surface.

16. The golf ball putting practice range apparatus of claim 13, wherein the means providing for changing the putting surface contour comprises means for changing the contour generally transversely of the longitudinal axis of the putting surface.

17. The golf ball putting practice range apparatus of claim 13, wherein the means providing for changing the putting surface contour comprises means for changing the contour generally longitudinally of the putting surface.

18. A golf ball putting practice range apparatus comprising:

a shooting area upon which a golfer stands when putting a golf ball;

a putting surface immediately downstream of the shooting area across which the golfer hits the ball;

means defining at least one golf ball target hole at the downrange end of the putting range selectively movable in a straight line transversely of the longitudinal axis of the putting surface;

means for selectively moving the golf ball target hole defining means for selectively repositioning the golf ball target hole transversely of the longitudinal axis of the putting surface; and, golf ball return means extending from beneath the golf ball target hole defining means to the top surface of the shooting area for returning golf balls to the top surface of the shooting area.

19. The putting practice range apparatus of claim 18, wherein the golf ball return means comprises golf ball dispensing means for raising returned golf balls to the top surface of the shooting area.

20. The putting practice range apparatus of claim 19 wherein the golf ball dispensing means comprises:

golf ball guide way means for guiding returned golf balls to a location at the top surface of the shooting area; and, golf ball moving means for moving the returned golf balls along the path defined by the guide way means.

21. A golf ball putting practice range apparatus having a selectively contourable putting surface comprising:

a plurality of planar sections disposed in adjacent edge-to edge juxtaposition;

hinge means interconnecting the juxtaposed edges of the planar actions so that the planar sections can move realtive to each other about their edge-to-edge interface; and, contour changing means associated with one of the planar sections for selectively tilting this one section about the longitudinal axis of the putting surface, or about the transverse axis of the putting surface, or concurrently about both the transverse axis and longitudinal axis of the putting surface, wherein the other planar sections tilt at an angle to the horizontal in response to the movement of the one section associated with the contour changing means about either the longitudinal axis of the putting surface, or the transverse axis of the putting surface, or concurrently about both the transverse axis and longitudinal axis of the putting surface.

22. The contourable putting surface of claim 21, wherein the one planar section to which the contour changing means is associated is the center section.

23. The contourable putting surface of claim 21, wherein the one planar section to which the contour changing means is associated is tilted about its geometric center.

24. The contourable putting surface of claim 21, wherein the contour changing means comprises at least one cam and a cam follower interconnecting the cam and the one planar section.

25. The contourable putting surface of claim 21, wherein the contour changing means comprises:

a first cam and a cam follower interconnecting the cam and the one planar section for tilting the one planar section laterally of the longitudinal axis of the putting surface, and, a second cam and cam follower interconnecting the cam and the one planar section for tilting the one planar section longitudinally of the putting surface.

* * * * *